US005134759A

United States Patent [19]

Hacker et al.

[11] Patent Number: 5,134,759

[45] Date of Patent: Aug. 4, 1992

[54] PLATE AND SEPARATOR CONTAINING SUCH A PLATE FOR SEIZING AND SEPARATING THREADS

[75] Inventors: Hans-Eugen Hacker; Klaus Esser, both of Reutlingen, Fed. Rep. of Germany

[73] Assignee: Hermann Wangner GmbH & Co. KG, Fed. Rep. of Germany

[21] Appl. No.: 660,826

[22] Filed: Feb. 26, 1991

[30] Foreign Application Priority Data

Feb. 26, 1990 [DE] Fed. Rep. of Germany ... 9002278[U]

[51] Int. Cl.[5] ..... D02J 1/18; D03D 3/04

[52] U.S. Cl. ..... 28/141; 28/202

[58] Field of Search ..... 28/141, 202, 203.1, 28/204, 205, 206, 207, 140, 201

[56] References Cited

U.S. PATENT DOCUMENTS

| | | | |
|---|---|---|---|
| 977,166 | 11/1910 | Colman | 28/202 |
| 1,207,249 | 12/1916 | Wenzel | 28/202 |
| 2,313,195 | 3/1943 | Fleischer et al. | 28/202 |
| 2,413,881 | 1/1947 | Meier | 28/202 |
| 4,581,794 | 4/1986 | Oldroyd et al. | 28/141 |
| 4,736,499 | 4/1988 | Kopcke | 28/141 |
| 4,860,411 | 8/1989 | Vohringer | 28/202 |
| 4,866,821 | 9/1989 | Hacker et al. | 28/141 |
| 5,003,675 | 4/1991 | Esser et al. | 28/141 |

FOREIGN PATENT DOCUMENTS

| | | | |
|---|---|---|---|
| 536421 | 10/1931 | Fed. Rep. of Germany | 28/202 |
| 1285957 | 12/1968 | Fed. Rep. of Germany | 28/202 |

*Primary Examiner*—Werner H. Schroeder
*Assistant Examiner*—Amy Brooke Vanatta
*Attorney, Agent, or Firm*—Sughrue, Mion, Zinn, Macpeak & Seas

[57] ABSTRACT

A plate for a separator for the successive seizure and separation of threads held in an array has a leading edge and at least one hook-shaped recess in the leading edge. The recess has a depth in the direction of plate movement which is greater than half the width of the recess. Between a hook tip and the leading edge there extends a fender edge at an angle of 15° to 90° relative to the direction of plate movement. The hook tip is rounded with a radius of up to 10% of the width of the hook-shaped recess.

3 Claims, 1 Drawing Sheet

PLATE AND SEPARATOR CONTAINING SUCH A PLATE FOR SEIZING AND SEPARATING THREADS

BACKGROUND OF THE INVENTION

The present invention relates to a thread separator including a plate having a hook-shaped recess for seizing and separating threads held in an array.

Such separators are parts of a seam weaving machine for making endless sheet forming fabrics for use in papermaking machines. The array of threads is a magazine-type thread holding band in which the longitudinal threads of the sheet forming fabric are held by interweaving with transverse threads. In order to form the woven seam the longitudinal threads must be taken or separated successively one by one out of the array of threads. The longitudinal threads of such sheet forming fabrics generally have diameters within the range of about 0.15 to 0.22 mm.

The plate has a leading edge facing the array. The hook-shaped recess forms a base edge recessed from the leading edge where the thread to be separated lies before being seized and held by the hook-shaped recess upon shifting of the plate. The separator includes a frame in which at least one plate is slidably guided for seizing the foremost thread of an array. Drive means are provided for moving the plate.

Plates and separators of this design are known from DE-U-81 22 450, DE-U-87 06 649, DE-A 37 12 169, DE-A-37 14 517, EP-A-289 640 and U.S. Pat. No. 4,866,821 with each plate being formed with one or two hooks conforming to the diameter of the thread to be seized. The recess is semicircular so that the thread bears against the hook-shaped recess with half its circumference. The relation of the hook-shaped recess to the thread diameter must be very accurate in order to accomplish, on the one hand, safe gripping of the foremost thread of the array and, on the other hand, to prevent piercing and entraining of the next following thread. Nevertheless, a certain number of failures is inevitable. Failure may be due to the fact that the foremost thread is not seized or that not only the foremost but also the next following thread is seized. Each failure results in the standstill of the seaming machine.

In the separators disclosed in DE-U-81 22, 450, DE-U-87 06 649, DE-A-37 12 169, De-A-37 14 517 and EP-A-289 640, each successive thread is seized by being urged by the hook against the frame. The thread to be seized with the separators of U.S. Pat. No. 4,866 821 is grasped between the confronting hooks of at least two plates with one hook being adapted to the diameter of the thread to be separated and the cooperating other hook being of about half the size. The smaller hook pierces the thread at about half its width and urges it into the larger hook. With plates provided with hooks the positive engagement can extend maximally to half the circumference. Threads that are firmly engaged in the serial arrangement cannot therefore be safely separated.

Plates are also known where the hook is replaced by a piercing needle which enters the thread in order to grip it as in Applicants copending U.S. application Ser. No., 07/495,963 filed Mar. 20, 1990, now U.S. Pat. No. 5,003,675. However, there is a risk that the needle will extend through the thread and penetrate other threads.

SUMMARY OF THE INVENTION

The present invention has the object of providing a plate for a separator wherein the error rate in selecting and separating thread is greatly reduced.

According to the present invention, this object is realized in that the hook-shaped recess in the plate seen in the direction of plate movement has a depth greater than half the width of the recess.

The greater depth of the recess permits especially safe grasping and holding of the thread. Surprisingly, it has been found that the risk of also seizing the next following thread does not exist. The width of the hook-shaped recess can be in the rang of 20% more and up to 30% less than the diameter of the thread. The depth of the hook-shaped recess does not have to precisely match the thread diameter. The greater depth of the hook-shaped recess ensures that in any event the thread to be separated will be positively seized.

Preferably the tip of the hook is rounded with a radius of about 1/10 of the width of the hook-shaped recess. This further reduces the risk of piercing the next following thread.

Preferably a fend-off edge extends at an angle of more than 15° but should be less than 90°.

Aside from the different form of the hook-shaped recess, the plate and the separator, according to the present invention, correspond to those of U.S. Pat. No. 4,866,821. Two constructions of the separator are conventional. In the first one disclosed in DE-U-81 22 450, the frame of the separator has two legs defining a mouth-like opening therebetween which is somewhat wider than the thickness of the array of threads. The separator is moved forward so far that the base edge of the plate bears against the foremost thread to be separated with a selected defined force. As the plate is shifted by the drive means during the seizing stroke, the hook-shaped recess seizes the foremost thread of the array and urges it against the upper or lower leg of the mouth-like opening. Due to the great depth of the hook-shaped recess, the foremost thread is fully enclosed between the leg and the hook-shaped recess so that during the backward motion of the separator in the separating stroke, the thread cannot slip out of the hook-shaped recess.

In the other design of the separator, the thread to be separated is held between two or three plates. In order to avoid tilting of the thread, it is suitably seized on one side by the hook-shaped recesses of two plates and on the other side by the hook-shaped recess of an interposed plate. This mode of operation is described in detail in U.S. Pat. No. 4,866,821 in connection with FIG. 5. It is sufficient when the central plate is designed according to the invention with a hook-shaped recess, while the two other plates may have merely a step. The hook-shaped recess of the central plate containing the thread is closed, so as to say, by steps in the two external plates so that the thread is completely locked in. With the design of the separator operating with a plurality of plates the hook-shaped recesses or steps approach the thread to be separated and seize it in its position predetermined by the fabric weave. In this way, the thread is not lifted out of the plane of the array upon the seizing stroke nor is it urged into the crimp structure of the transverse threads of the array. Urging the thread to be separated into the crimp structure of the transverse threads in the first mode of design of the separator occasionally has the consequence that the thread to be separated does not come free of the fabric texture of the array. A further advantage of the second design of the separator resides in the possibility of handling arrays with very closely packed weave.

The plate and the separator of the present invention are especially suited for seaming double-layer fabrics.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
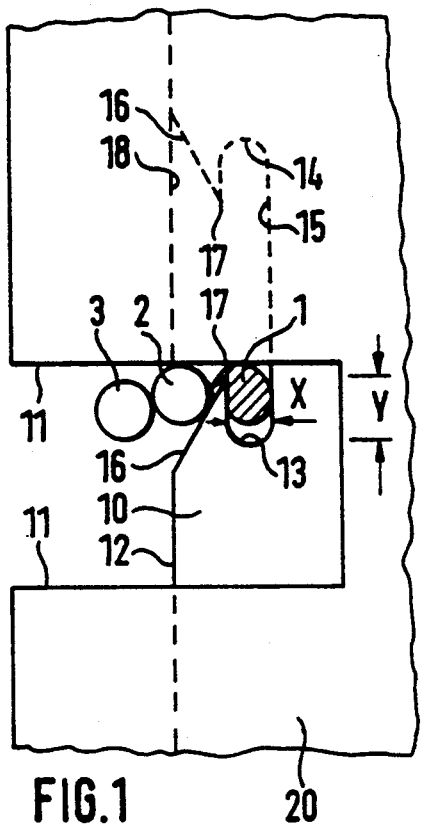
FIG. 1 shows, in section transversely of the threads to be separated, a plate within the mouth opening of the separator.

Since the construction of the separator 20 is basically conventional, FIGS. 1–4 only show part of the plate 10 and the mouth-shaped opening 11 of the separator 20. Furthermore, only the three foremost threads 1, 2 and 3 of an array are shown. The plate 10 in each instance is shown in the position which it takes at the end of a seizing stroke after it has seized the foremost thread of the array.

The plate has a leading edge 12 having a lower hook-shaped recess 13 and an upper hook-shaped recess 14 with one hook tip 17 adjacent each recess. The recesses 13, 14 form a base edge 15 recessed from the forward edge 12. The hook-shaped recesses 13, 14 are each connected by a fend-off edge 16 to the leading edge 12.

The width X of the recesses 13, 14 ranges from 20% larger to 30% smaller than the diameter of the threads 1, 2, 3 so that a plate 10 may be used for threads whose diameters vary up to 50%. When the width X of the hook-shaped recess 13, 14 is larger than the thread diameter, the recess 13, 14 can readily seize the thread. There is no risk that the next following thread 2 will be seized by the recess 13, 14 since the thread 2 is fended off by the fend-off edge 16 and thus, the threads 1 and 2 are separated. If the thread diameter is larger than the width X of the recess 13, 14, either the cross section of the thread 1 will be compressed or the tip 17 of the hook will penetrate somewhat into the material of the thread 1. In both cases, safe seizure of the thread by the recess 13, 14 is warranted.

Figure 2:
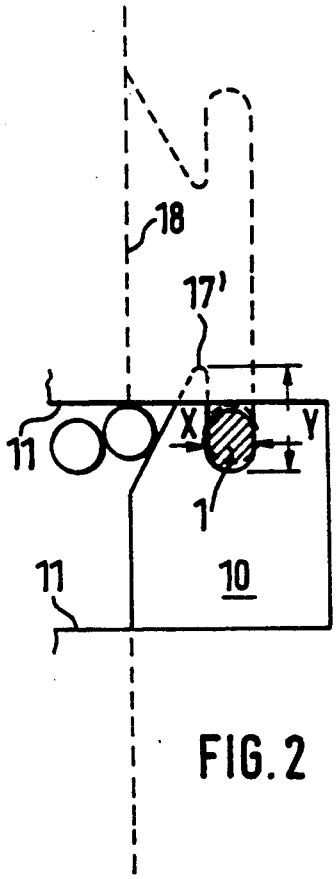
FIG. 2 shows a view similar to that of FIG. 1 with a rounded hook tip plunging into a window in the separator leg.

If the thread 1 is pierced, there is always the possibility that the thread 1 will be split by the hook tip 17. However, the hook tip 17 can be provided with a radius which may be up to 1/10 of the width X. FIG. 2 shows such a plate 10 with rounded hook tip 17'. In order to achieve complete enclosure of the thread 1 between the recess 13 and the upper leg of the opening 11, the hook tip 17, at the end of the seizing stroke, enters the guide slot 18 in which the plate 10 is moving. Hence, in the situation illustrated in FIG. 2, there is overlapping between the hook tip 17' and the upper leg of the opening 11.

Figure 3:
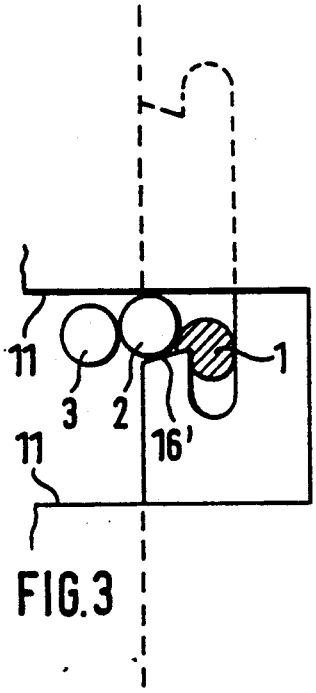
FIG. 3 is a view similar to that of FIG. 1 with a different configuration of the fending-off edge.

While in FIGS. 1 and 2 the fend-off edge extends at an angle of about 30° with respect to the seizing stroke direction of movement of the plate 10, said angle is substantially greater in the example of FIG. 3, namely about 80°. It may be that the succeeding thread 2 is clamped between the fend-off edge 16' and the leg of the opening 11 during the seizing stroke. During the subsequent separation stroke, which is directed towards the right hand side in the presentation of the Figures, the thread 2 is not taken along so that reliable separation of the first thread 1 from the next following threads 2, 3 is ensured.

Figure 4:
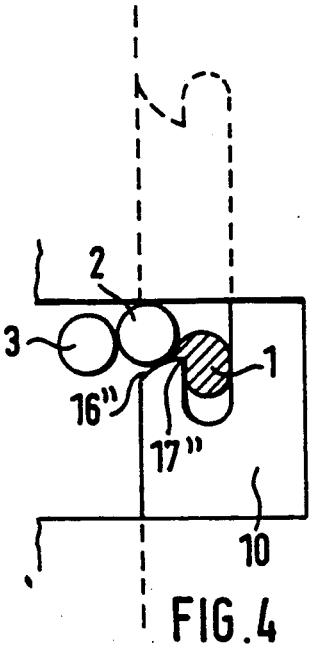
FIG. 4 is a view similar to that of FIG. 1 with a still further configuration of the fending-off edge.

In the embodiment of FIG. 4, the fend-off edge 16" is curved in upward direction to the hook tip 17".

The separator illustrated in the drawing is of the initially mentioned first design where the thread is clamped between the hook of a plate 10 and a leg of the mouth-like opening 11. However, the plate of the invention is applicable also in separators having a plurality of plates wherein the foremost thread of the array is clamped between the hook of two plates. Such separators are used especially in multi-layer papermaking fabrics. Each plate can have one or two hook-shaped recesses 13, 14. In case of several hook-shaped recesses, the latter may have varying dimensions.

The plates are fabricated from spring steel sheet of 0.10 to 0.35 mm thickness and are cut out by electrical wire discharge machining.

While the invention has been particularly shown and described with reference to preferred embodiments thereof, it will be understood by those in the art that the foregoing and other changes in form and details may be made therein without departing from the spirit and scope of the invention.

What is claimed is:

1. A plate for a separator for the successive seizure and separation of threads held in an array, said plate having a leading edge and at least one hook-shaped recess in the leading edge, said hook-shaped recess having a width perpendicular to the leading edge, a depth parallel to the leading edge and a hook tip, wherein said recess has a depth greater than half the width of the recess and wherein said hook tip is rounded with a radius of up to 10% of the width of the hook-shaped recess.

2. A plate according to claim 1, wherein a fend-off edge extends between the hook tip and the leading edge at an angle 15°–90° relative to the depth of the recess.

3. A separator for successively grasping and separating threads held in an array comprising a frame having an opening extending into one of the frame, a guide slot disposed perpendicular to and intersecting said opening and a plate slidably mounted in said guide slot for movement across said opening, wherein said plate has a leading edge and at least one hook-shaped recess in the leading edge, said hook-shaped recess having a width perpendicular to the leading edge, a depth parallel to the leading edge and a hook tip, wherein said recess has a depth greater than half the width of the recess and wherein said hook tip is rounded with a radius of up to 10% of the width of the hook-shaped recess.

* * * * *